US007743430B2

(12) United States Patent
Jennings et al.

(10) Patent No.: US 7,743,430 B2
(45) Date of Patent: Jun. 29, 2010

(54) CONCEAL AND CARRY VEST

(76) Inventors: Kathleen Jennings, 702 SW. Williams St., Lee's Summit, MO (US) 64081; Diana Ruggles, 702 SW. Williams St., Lee's Summit, MO (US) 64081

( * ) Notice: Subject to any disclaimer, the term of this patent is extended or adjusted under 35 U.S.C. 154(b) by 304 days.

(21) Appl. No.: 11/102,117

(22) Filed: Apr. 8, 2005

(65) Prior Publication Data

US 2005/0223466 A1 Oct. 13, 2005

Related U.S. Application Data

(60) Provisional application No. 60/560,940, filed on Apr. 9, 2004.

(51) Int. Cl.
*A41D 13/00* (2006.01)

(52) U.S. Cl. ..... 2/94

(58) Field of Classification Search ..... 2/93, 2/94, 102, 108, 69, 85, 247–252, 2.5, 115; 224/192, 196, 198, 911, 912, 901.6, 901.8
See application file for complete search history.

(56) References Cited

U.S. PATENT DOCUMENTS

| | | | | |
|---|---|---|---|---|
| 4,637,075 | A * | 1/1987 | Ingrisano et al. | 2/94 |
| 5,294,031 | A * | 3/1994 | Volpei et al. | 224/682 |
| 5,431,318 | A * | 7/1995 | Garcia | 224/192 |
| 5,692,237 | A | 12/1997 | Bennett | |
| 6,131,198 | A * | 10/2000 | Westrick | 2/102 |
| 6,324,697 | B1 * | 12/2001 | Shofner | 2/102 |
| 6,760,922 | B1 * | 7/2004 | Morales | 2/94 |
| 6,986,164 | B1 * | 1/2006 | Morales | 2/94 |

* cited by examiner

*Primary Examiner*—Tejash Patel
(74) *Attorney, Agent, or Firm*—Mark Manley

(57) ABSTRACT

A gun concealment garment such as a vest including a vest side including an outer layer and an inner liner connected at an arm hole and a center seam, the outer layer and the inner liner forming a concealing pocket. A concealed holster pocket within the concealing pocket, the concealed holster pocket adapted to hold a gun. The concealed holster pocket supported from the center seam such that the weight of a gun carried in the concealed holster pocket is supported directly by the shoulder of a wearer reducing the tendency for the gun to map and increasing the comfort of a wearer.

12 Claims, 4 Drawing Sheets

CONCEAL AND CARRY VEST

RELATED APPLICATIONS

This application claims priority of provisional patent application 60/560,940 filed Apr. 9, 2004.

BACKGROUND OF THE INVENTION

It is sometimes necessary to carry a concealed weapon such as a hand gun or pistol. There have been a number of devices developed to aid a user carrying a concealed gun. Concealed guns have been carried on belt like devices designed to be covered by the pants or by a coat hanging over the belt. A problem with carrying a gun around the waist is that it tends to map. Mapping is the tendency for a concealed gun to show through the concealing garments. A gun worn near the waist tends to map because the clothing around the waist tends to be tight. One solution to mapping is to wear loose covering garments such as a coat that hangs down over the waist but loose layers of clothing can make it difficult for an individual, such as an under cover police officer, to draw a gun quickly. Often time the additional layers of clothing are hot and uncomfortable to wear.

An alternative to concealed belts is a shoulder holster worn under a coat. A shoulder holster can carry a concealed gun generally under either arm, usually the gun is under the opposite arm from which the person would use to draw the gun. The shoulder holster can provide a natural ergonomic reach to facilitate quick draw. The problems with shoulder holsters are that the holster is an additional item of clothing and the garment worn over the shoulder holster to hide it can make drawing the gun difficult if the concealing garment is closed at the front and can gap open to reveal the concealed gun if worn with the front open.

U.S. Pat. No. 5,692,237 reveals a weapon concealment vest. The inside of this vest provides for a gun concealment patch 20 and a loop pile fastener system holding a holster 32. One problem with this device is that the concealment system really does not allow for a quick draw of the gun. The user must pull down the patch 20 and then pull the holster 32 from the Velcro straps and then draw the gun from the holster 32. This is a two handed operation that is too time consuming. Further the holster is worn on a forward panel 12 of the vest. The weight of the concealed gun will pull the vest down and forward on the user tending to make the garment uncomfortable to wear for long periods and further tending to allow the gun to hang and map against the front of the vest. The weight of the gun creates a torque about the arm hole, if free to do so, the gun would swing to hang directly under the arm hole. This torque creates the problems of mapping and discomfort in the prior art device.

U.S. Pat. No. 6,131,198 shows another gun concealment vest. The vest provides an ergonomic placement of the concealed gun in an external pocket 28, and provides for a system that could allow for a single handed quick draw. However, a gun concealed in this manner will map. Further since the gun is worn on the front panel of the vest it will tend to make the vest pull forward on the user making it uncomfortable to wear and increasing the tendency for the gun to map. In this prior art device the pocket 28 is actually very prominent on the front of the tactical vest and as such is primarily intended to provide a backup weapon as opposed to providing a truly concealed weapon. Again because the gun tends to be the heaviest part of the vest the weight of the gun carried in the forward pocket creates a torque where the gun is attempting to swing about the arm hole to a position directly under the arm.

This torque makes the vest uncomfortable to wear and increases the tendency for the gun to map.

Thus it can be seen that there is a need for a gun concealment system that prevents mapping, that is comfortable to wear even for long periods and that allows for a quick draw of the gun when needed.

SUMMARY OF THE INVENTION

The present invention provides a gun concealment garment including; a garment side having an outer layer and an inner liner connected at an arm hole and a center seam the outer layer and the inner liner forming a concealing pocket. A concealed holster pocket with the concealing pocket, the concealed holster pocket adapted to hold a gun. The concealed holster pocket supported from the center seam such that a gun carried in the concealed holster pocket is supported directly by the shoulder of a wearer reducing the tendency for the gun to map and increasing the comfort of wearing the garment.

DETAILED DESCRIPTION OF THE DEVICE

Figure 1:
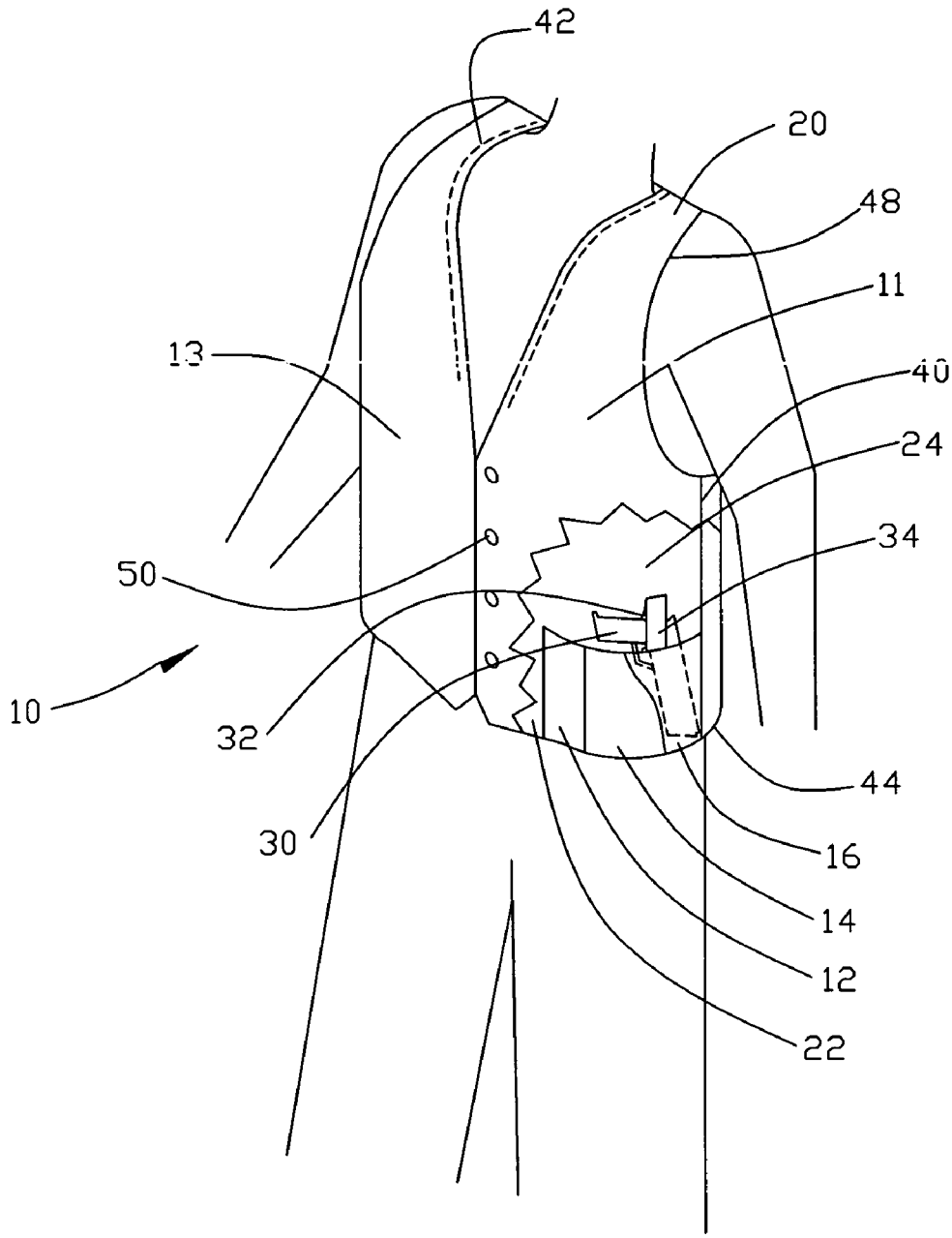
FIG. 1 shows a perspective view with a cut away, of the device in use.

FIG. 1 shows a perspective view of the gun concealment vest 10 in use. The vest 10 includes a series of pockets 12, 14 and 16. A portion of the outer layer 20 of the vest 10 has been cut away to reveal the pockets. The pockets 12, 14 and 16 can be fastened to an inner lining 24. The outer layer 20 and inner lining 24 cooperate to form a large concealing pocket 22 which contains the pockets 12, 14 and 16. The gun 30 can be held in the holster pocket 16 by quick release loop pile fastener straps 32 and 34. While the holster pocket 16 can be specially configured to hold the barrel portion of the gun 30, the pockets 12 and 14 can provide other utility such as to carry rounds of ammunition or a cell phone for example. The holster pocket 16 is at least partially fastened to the center seam 40 of the vest 10 such that the weight of the gun 30 is supported from the center seam 40. The center seams 40 of the vest 10 are under each arm of the wearer and can extend to the bottom seam 44. The vest 10 can be symmetrical, with the left 11 and right 13 sides being essentially mirror images of each other with the possible exception of the exterior features shown in FIG. 2. A neck seam 42, center seams 40, bottom seam 44 and arm holes 48 can fasten the inner lining 24 to the outer layer 20. Fasteners such as snaps 50 can connect the left side 11 to the right side 13 when the vest is worn. Some of the snaps 50 can be left unfastened to facilitate the ability of the wearer to reach into one of the concealing pockets 22.

Figure 2:
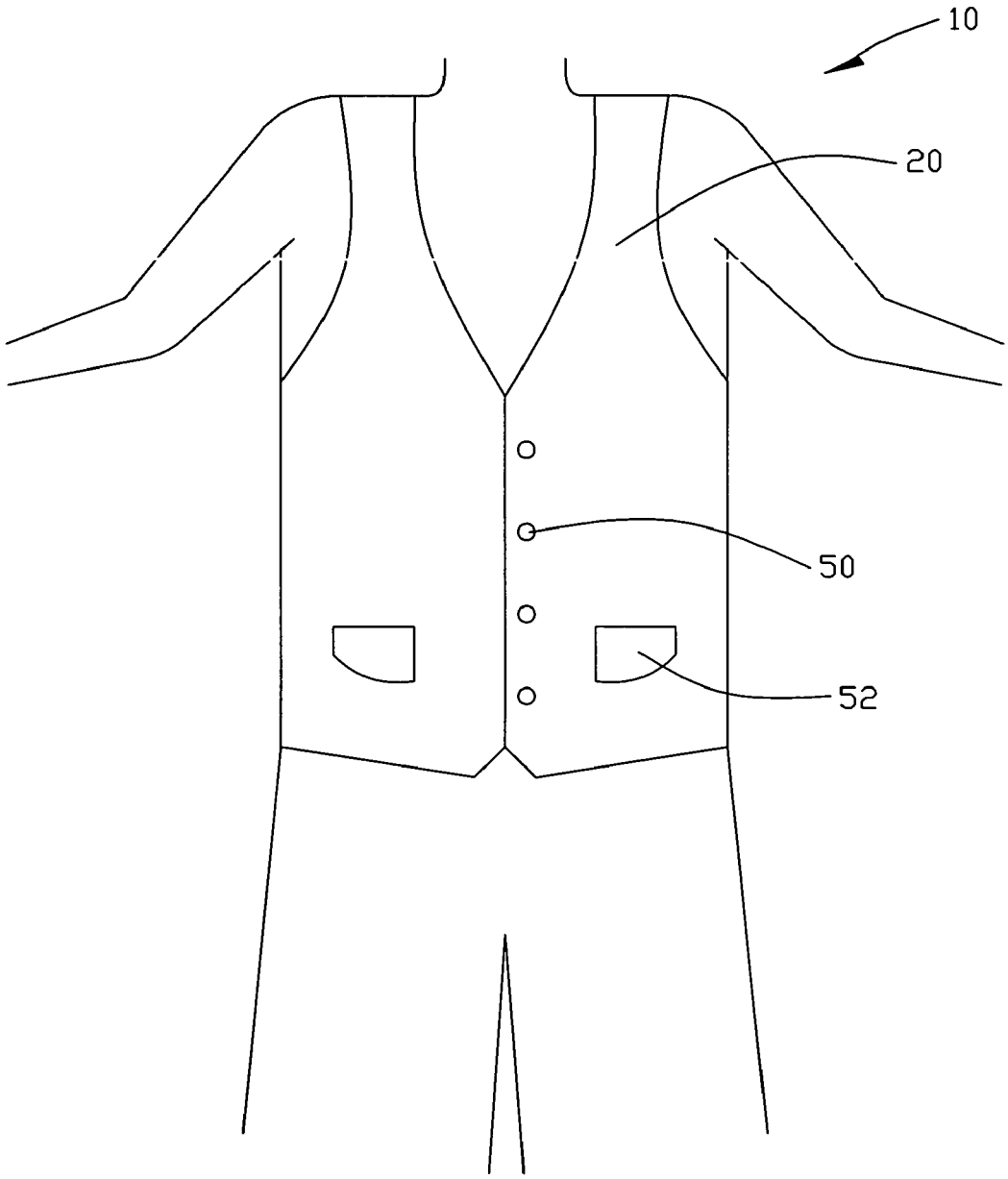
FIG. 2 shows an external view of the device in use.

FIG. 2 shows an external view of the vest 10 as worn. The vest 10 can have typical trim pieces such as snaps 50 and pockets 52 attached to the outer layer 20. These can be used to give the vest 10 any appearance that the user might want. Leaving some or all snaps 50 unconnected can provide quick access to the concealing pockets 22 shown in FIGS. 1, 3 and 4.

Figure 3:
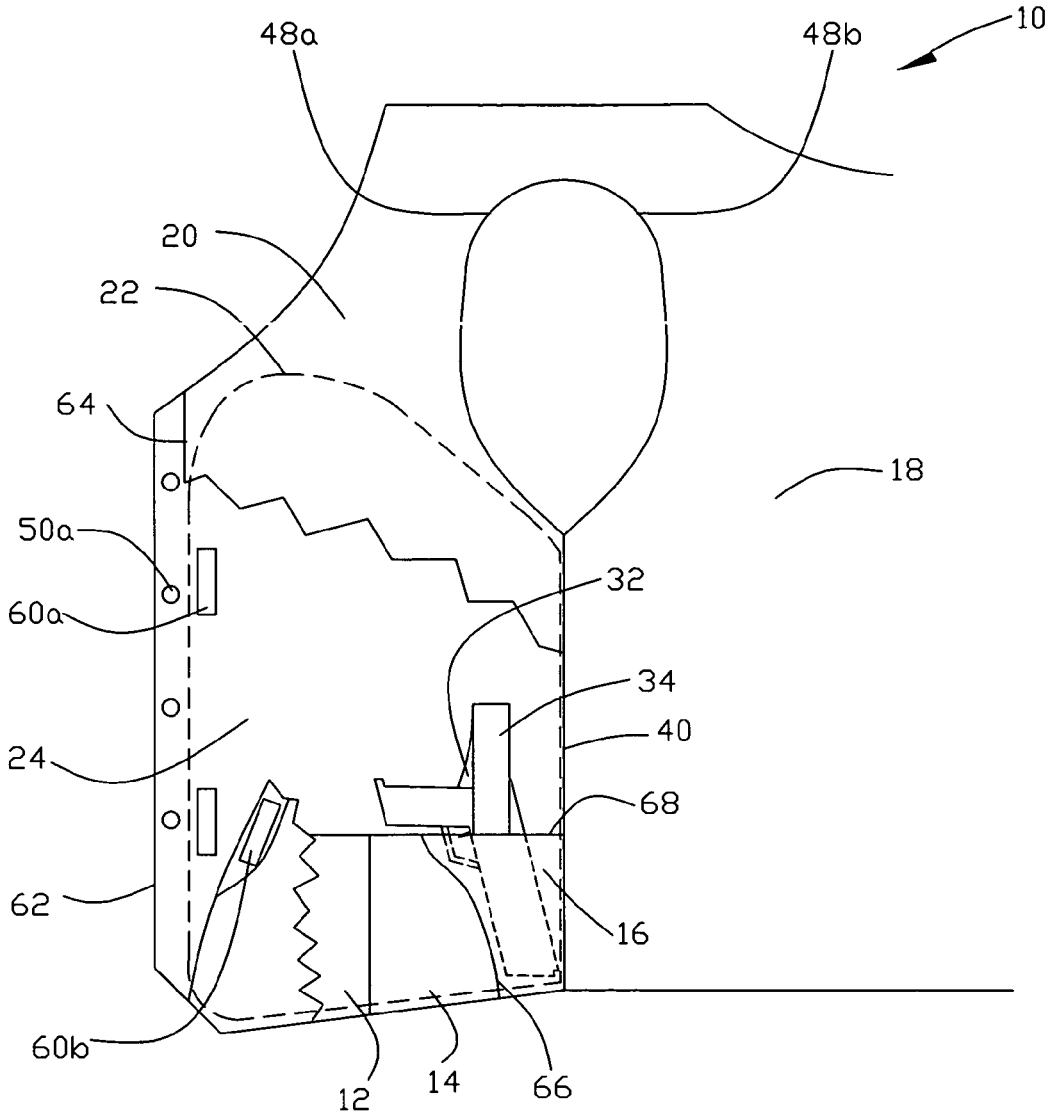
FIG. 3 shows a partial cut away view of the device.

FIG. 3 shows a partial cut away view of the left side 11 of the vest 10. A portion of the outer layer 20 has been cut away to reveal a portion of the inner lining 24 and the interior of concealing pocket 22. The inner lining 24 can include pockets 12 and 14 which are intended to carry small optional items such an ammunition or a cell phone for example. The pocket 16 is designed to carry the gun 30 and can include a forward seam 66 that curves, causing the pocket 16 to be wider at the top of the pocket 68 than it is at the bottom of the pocket. The wider pocket top 68 allows for the trigger portion of the gun 30 to enter the pocket and also allows the gun 30 to tilt slightly toward the front of the vest 10 facilitating the removal of the gun 30 when needed. The pocket 16 includes loop pile fasteners 32 and 34 that normally cooperate to hold the gun 30 in the pocket 16 but that will automatically separate as the gun 30 is pulled from the pocket 16. The loop pile fastener 32 can be sewn to the inner lining 24 and the loop pile fastener 34 can be sewn to the pocket 16, the connection point of the loop 34 to loop 32 determines how tightly the gun is held in the pocket 16. FIG. 3 also shows a portion of the vest back 18 which connects the left side 11 to the right side 13. The loop pile fastener 32,34 does not need to attach to the gun, rather loop over the gun 30 over the pocket 16 such that the gun 30 cannot exit the pocket 16 until a hand reaching into the pocket 22 fastener32, from 34 by pulling the gun.

FIG. 3 also shows that quick release fasteners 60*a* and 60*b* hold the outer layer 20 to the inner lining 24 at the opening of concealing pocket 22. The opening of the concealing pocket generally occurs at the front edge 64 of the outer layer 20.

The general outline of pocket 22 is shown in dashed lines in FIG. 3. The front edge 64 of outer layer 20 is spaced from the front edge 62 of the inner lining 24, that space provides room for snap halves 50*a* and assists the user in finding the front edge 64 of the concealing pocket 22 to facilitate opening the concealing pocket 22. The back edge of the concealing pocket 22 is formed by the center seam 40 which also forms the back edge of pocket 16. In constructing the vest 10 a single seam can be taken to form the center seam 40, the back edge of concealing pocket 22 and the back edge of pocket 16, the center seam 40 also forms part of the attachment of the cover layer 20 to the inner lining 24.

Figure 4:
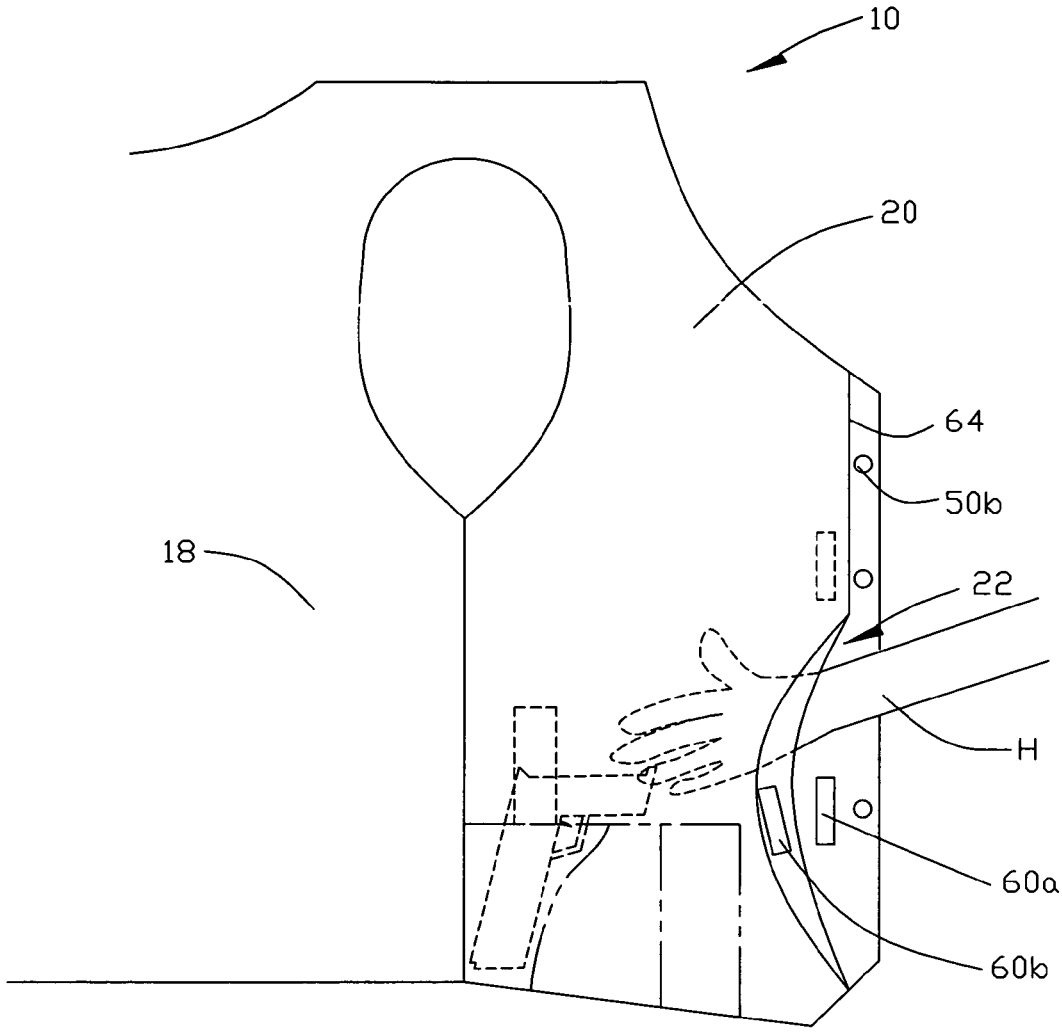
FIG. 4 shows a partial cut away view of the device.

FIG. 4 shows the right side 13 of the vest 10 which is essentially a mirror image of the left side 11 shown in FIG. 3. In this view the front layer 20 is shown complete. A hand H is reaching past front edge 64 of the layer 20 and into concealing pocket 22 to access the gun 30. As the hand H reaches into the pocket 22 the quick release fasteners 60*a* and 60*b* can come open allowing more space for the hand H. It will be understood that the quick release fasteners 60*a* and 60*b* could be any of a number of choices including loop pile fasteners or snaps.

Referring now to FIG. 1, in use a wearer has a gun 30 in a concealed holster pocket 16. The holster pocket 16 is in turn concealed inside the concealing pocket 22 that is created between the cover layer 20 and the inner lining 24. The weight of the gun 30 is supported essentially by the center seam 40 since the pocket 16 is attached at least in part to the center seam 40. The weight of the gun 30 is supported by the center seam 40 which in turn hangs essentially evenly from the front 48*a* and back 48*b* of the arm hole 48 and in turn is supported directly from the shoulder of the wearer. The gun 30 hangs straight down from the arm and shoulder and does not create a torque around the arm hole as in the prior art. This arrangement allows the gun 30 to hang straight down such that it will not map or cause the vest 10 to pull forward on the user as occurs in the prior art devices when the gun is supported toward the front of the left side spaced from the side seam. Referring to FIGS. 3 and 4 the gun 30 can be drawn using one hand H by slipping the fingers under the front edge 64 of the cover layer 20 and popping the quick release fasteners 60*a* and 60*b* open as needed to allow the hand H to fully enter the concealing pocket 22. The gun 30 can then be grasped and pulling on the gun 30 will cause loop pile fasteners 32 and 34 to separate releasing the gun 30. The shape of the front seam 66 of the pocket 16 is curved to allow the gun to tilt slightly to a desired draw position. The pocket 16 narrows at the bottom to hold the gun barrel from undesirable movement.

It will be understood by those skilled in the art that two guns 30 could be carried at the same time, one on the left side 11 and one on the right 13. It will also be understood that though loop pile fasteners 32, 34 are shown, any quick release device could be used to allow the gun 30 to be quickly released from the pocket 16. It will also be understood that though the device is shown as a vest 10, long or short sleeves could be added to make the garment a shirt or coat.

The invention claimed is:

1. An upper body gun concealment garment including;

at least two arm holes and a front opening a garment side having an outer layer and an inner liner connected at an arm hole and a center seam directly below said arm hole and extending from said arm hole to a waist of said garment, said outer layer and said inner liner forming a concealing pocket having a first pocket opening substantially adjacent the front opening of the garment and, a concealed holster pocket within said concealing pocket;

said concealed holster pocket having a second pocket opening and a shape to hold a gun;

said concealed holster pocket has a first edge formed by said center seam said concealed holster pocket has a second curved edge that is shaped to match a portion of said gun to firmly hold said gun in said concealed holster pocket and wherein said concealing pocket and said concealed holster pocket are supported by the center seam.

2. The gun concealment garment of claim 1 wherein said concealing pocket includes loop pile closures.

3. The gun concealment garment of claim 1 wherein the holster pocket includes a loop pile fastener adapted to hold the gun in said holster pocket.

4. The gun concealment garment of claim 1 wherein the concealing pocket includes an opening adjacent a front opening of the garment.

5. The gun concealment garment of claim 1 wherein the garment is a vest.

6. A gun concealment vest including;

a vest side having an outer layer and an inner liner connected at an arm hole and a center seam below the arm hole and extending to a waist of said garment, said outer layer and said inner liner forming a concealing pocket having a first pocket opening substantially adjacent to a front opening, a concealed holster pocket within said concealing pocket;

said concealed holster pocket including a second opening for said gun and said concealed pocket shaped to hold a gun;

said concealed holster pocket having a first edge formed by said center seam such that a gun carried in said concealed holster pocket is supported directly from the arm hole when the vest is worn and wherein a second edge of said holster pocket is curved such that said holster pocket is narrower at a bottom edge than at a top edge of said holster pocket and wherein said concealing pocket and said concealed holster pocket are supported by the center seam.

7. The gun concealment vest of claim 6 wherein said concealing pocket includes loop pile closures.

8. The gun concealment vest of claim 7 wherein the holster pocket includes a quick release fastener adapted to hold the gun in said holster pocket.

9. The gun concealment vest of claim 8 wherein said vest includes a second concealing pocket containing a second concealed holster pocket.

10. A gun concealment upper body garment comprising;

a side having an outer layer and an inner liner connected at an arm hole and a center seam below the arm hole, said outer layer and said inner liner forming a concealing pocket having a first access opening substantially adjacent to a front opening, a concealed holster pocket within said concealing pocket;

said concealed holster pocket having a second opening and said concealed pocket adapted to hold a gun;

said concealed holster pocket has a first edge that is attached directly to said center seam and supported such that a gun carried in said concealed holster pocket is supported directly from the arm hole when the garment is worn and said concealed holster pocket has a second curved edge that is shaped to match a portion of said gun to firmly hold said gun in said concealed pocket and wherein said concealing pocket and said concealed holster pocket are supported by the center seam.

11. The gun concealment garment of claim 10 wherein the center seam attaches a front portion of said vest to a back portion and attaches said holster pocket to said vest.

12. The gun concealment garment of claim 11 wherein the holster pocket includes a quick release fastener sewn to said holster pocket and adapted to hold the gun in said holster pocket.

* * * * *